US007614766B2

(12) United States Patent
Wang et al.

(10) Patent No.: US 7,614,766 B2
(45) Date of Patent: Nov. 10, 2009

(54) MODULAR ILLUMINATION DEVICE WITH ADJUSTABLE LIGHTING ANGLES

(75) Inventors: Bily Wang, Hsin Chu (TW); Hui-Chung Lin, Chia I Hsien (TW); Shih-Yu Wu, Pan Chiao (TW)

(73) Assignee: Harvatek Corporation, Hsin Chu (TW)

( * ) Notice: Subject to any disclaimer, the term of this patent is extended or adjusted under 35 U.S.C. 154(b) by 144 days.

(21) Appl. No.: 11/476,579

(22) Filed: Jun. 29, 2006

(65) Prior Publication Data

US 2008/0002413 A1 Jan. 3, 2008

(51) Int. Cl.
*F21V 21/26* (2006.01)

(52) U.S. Cl. ..... 362/269; 362/236; 362/270; 362/277; 362/418; 248/183.1; 248/183.2; 248/278.1

(58) Field of Classification Search ..... 362/236, 362/269, 304, 404, 800, 270, 277, 413, 418, 362/429; 248/183.1, 183.2, 278.1
See application file for complete search history.

(56) References Cited

U.S. PATENT DOCUMENTS 4,319,311 A * 3/1982 Mitchell ..... 362/250
5,154,509 A * 10/1992 Wulfman et al. ..... 362/648
5,341,276 A * 8/1994 Shen ..... 362/648
5,490,046 A * 2/1996 Gohl et al. ..... 362/35
5,567,043 A * 10/1996 Swanson ..... 362/250
5,584,574 A * 12/1996 Haddad ..... 362/359
5,584,576 A * 12/1996 Wei Hong ..... 362/396
6,669,355 B2 * 12/2003 Layne et al. ..... 362/294
7,001,047 B2 * 2/2006 Holder et al. ..... 362/296
7,178,937 B2 * 2/2007 McDermott ..... 362/187
7,290,896 B2 * 11/2007 Dallas et al. ..... 362/184
7,390,110 B2 * 6/2008 Katz et al. ..... 362/382
2003/0086267 A1 * 5/2003 Scholz ..... 362/277
2003/0193802 A1 * 10/2003 Luk ..... 362/249
2006/0039139 A1 * 2/2006 Maglica et al. ..... 362/202
2006/0092637 A1 * 5/2006 Yeh ..... 362/249

* cited by examiner

*Primary Examiner*—Sharon E Payne
*Assistant Examiner*—Mary Zettl
(74) *Attorney, Agent, or Firm*—Rosenberg, Klein & Lee

(57) ABSTRACT

A modular illumination device with adjustable illumination modules includes a substrate, a rotating element, a reflective element, an adjustable element, and a light-emitting element. The rotating element is rotatably disposed on the substrate and rotates corresponding to the substrate. The reflective element pivots on the rotating element and pivots corresponding to the substrate. The adjustable element is moveably disposed on the substrate and is moved corresponding to the reflective element. The light-emitting element is disposed on the adjustable element. The modular illumination device can be adjusted to shine light at any angle or in any direction. Furthermore, a plurality of illumination modules are combined to form the modular illumination device. By adjusting the lighting range and direction of the illumination modules respectively, the illumination device has different illumination ranges.

14 Claims, 4 Drawing Sheets

MODULAR ILLUMINATION DEVICE WITH ADJUSTABLE LIGHTING ANGLES

BACKGROUND OF THE INVENTION

1. Field of the Invention

The present invention relates to a modular illumination device with adjustable illumination modules, and particularly relates to a modular illumination device with a plurality of adjustable illumination modules that have an adjustable light range and an adjustable light direction. Furthermore, the adjustable light range and the adjustable light direction, when combined and operating together, form an adjustable illumination range.

2. Description of the Prior Art

Traditionally, a modular spotlight 1*a* has a plurality of light-emitting elements 2*a* which can include an LED, a metal halide lamp, and/or a light bulb. Moreover, the light-emitting element 2*a* has a substrate 3*a* that has a plurality of holes 4*a*, and the light-emitting elements 2*a* are respectively deposed inside the holes 4*a*. A modular spotlight 1*a* increases the brightness of the light via the light-emitting elements 2*a*. However, there are no adjustable structures to alter the angle of the light-emitting elements 2*a*. As such, after the light-emitting elements 2*a* are deposed in the holes 4 of the substrate 3*a*, the range or direction of the light-emitting elements 2*a* cannot be changed. Therefore, the illumination range of the spotlight 1*a* cannot be changed.

In the traditional manufacturing process for modular spotlights, a special substrate for the spotlight 1*a* is produced that has different angled holes 4*a*. This makes the light-emitting elements 2*a* shine in different directions and changes the illumination range. An alternative method provides light-emitting elements 2*a* that have different light ranges to change the illumination range of the modular spotlight. However, the cost and development time is large and is not viable under the keen competition of the modern marketplace.

Accordingly, this invention is provided to improve the abovementioned disadvantages of the modular spotlight.

SUMMARY OF THE INVENTION

It is an object of the present invention to provide a modular illumination device that allows a user to adjust the illumination direction of the illumination modules. The modular illumination device comprises a substrate, a rotating element, a reflective element, an adjustable element, and a light-emitting element. The rotating element rotatably is disposed on the substrate, and the rotating element rotates corresponding to the substrate. The reflective element is pivoted on the rotating element, and pivots corresponding to the rotating element. The adjustable element is moveably disposed on the substrate, and moves corresponding to the reflective element. The light-emitting element is disposed on the adjustable element.

The light range of the light-emitting element is therefore enlarged by adjusting the adjustable element up relative to the reflective element. The light range of the light-emitting element is reduced by adjusting the adjustable element down relative to the reflective element. The angle of elevation of the light is changed by adjusting the reflective element. The light direction can be rotated around 360 degrees by adjusting the rotating element. Thereby, a modular illumination device is provided for all illumination directions by adjusting the above elements.

Another object of the present invention is to provide an illumination module for adjusting the illumination range, wherein the modular illumination device is comprised of the illumination modules that are arranged in matrix. The modular illumination device further comprises a case, which includes a plurality of grooves in which the illumination modules are respectively disposed therein. By adjusting the light angle and direction of the illumination modules, the desired illumination range can be achieved by a user.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE EMBODIMENTS

Figure 1:
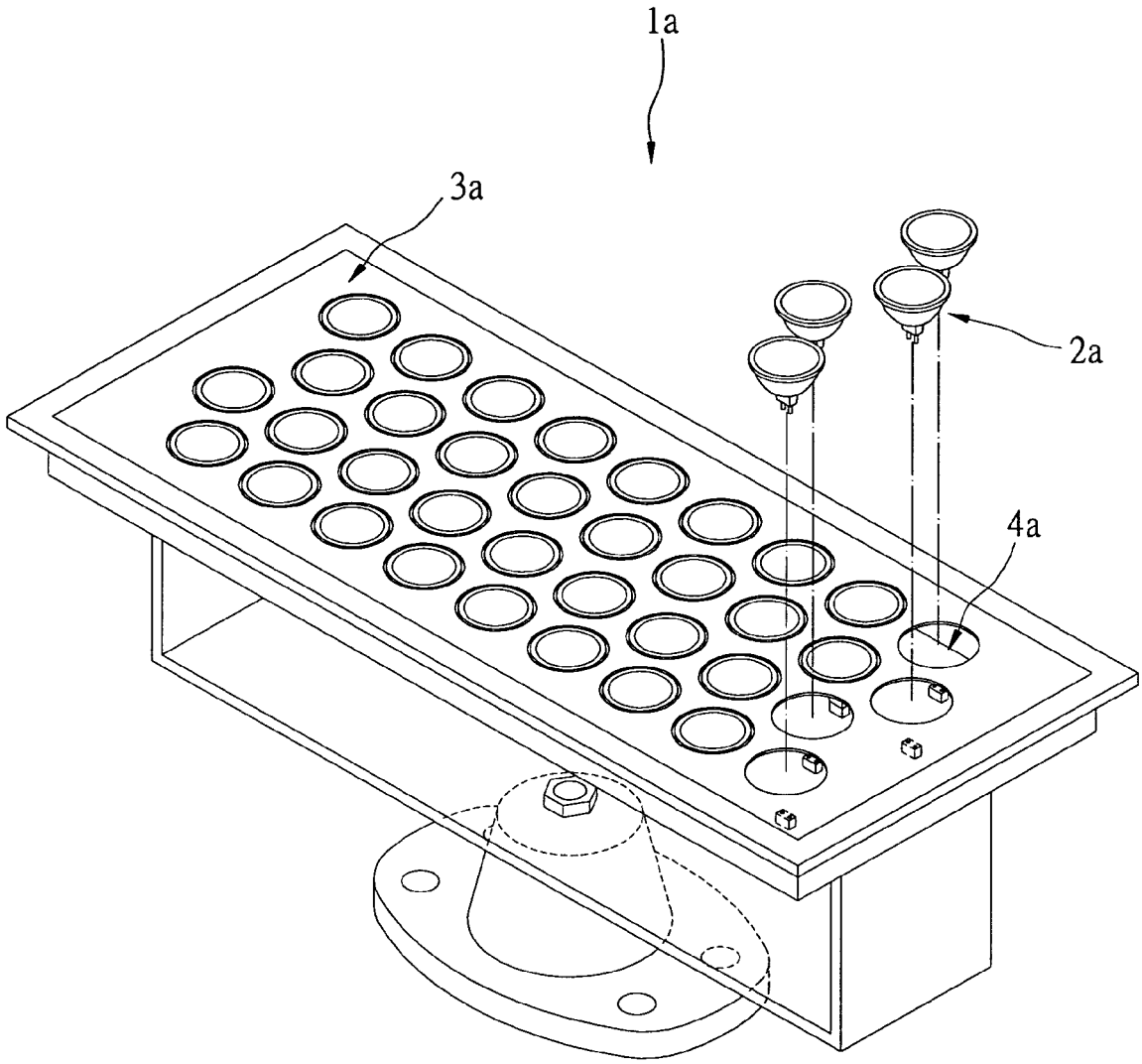
FIG. 1 PRIOR ART
FIG. 1 is a perspective view of a spotlight according to the prior art.
Figure 2:
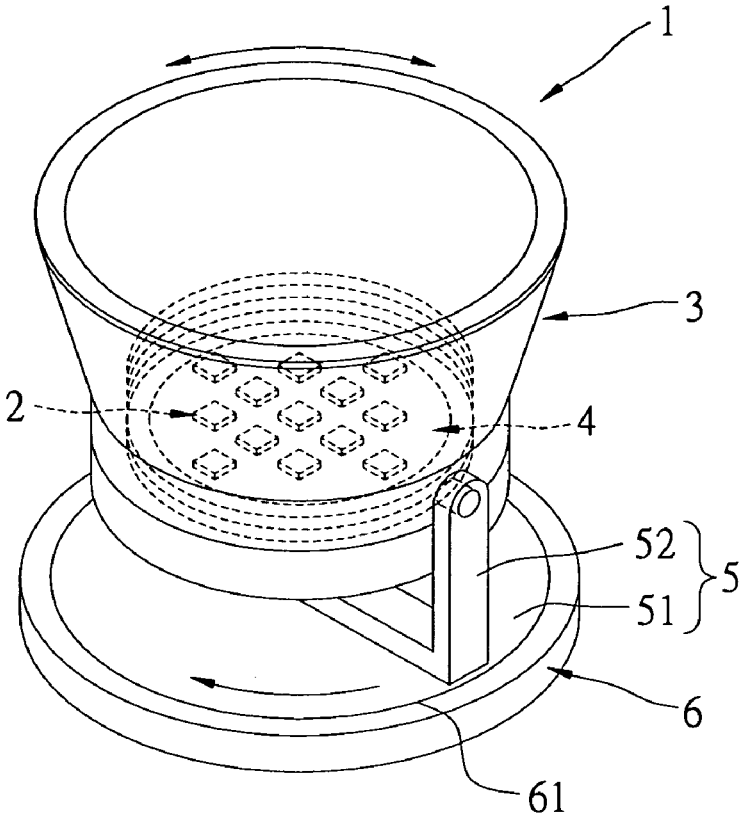
FIG. 2 is a perspective view of an illumination module of the present invention.
Figure 3:
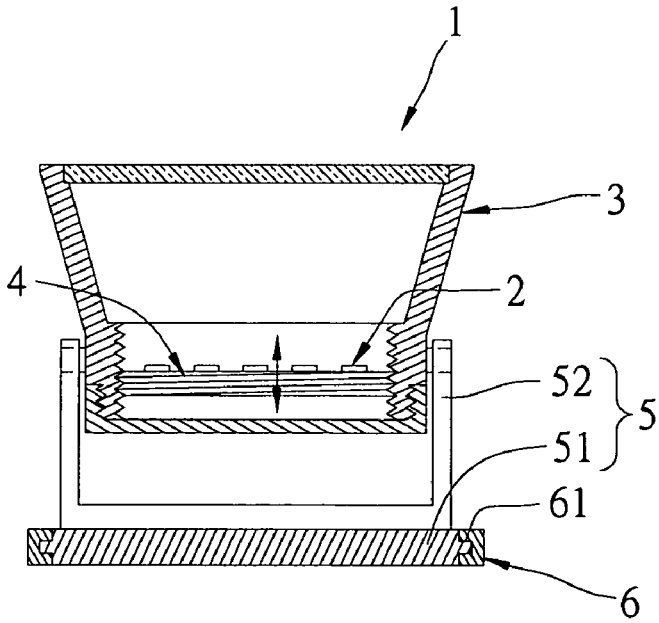
FIG. 3 is a cross-sectional view of an illumination module of the present invention.

FIG. 2 and FIG. 3 are respectively a perspective view and a cross-sectional view of the illumination module 1 with adjustable lighting angles. The illumination module 1 comprises a light-emitting element 2, a reflective element 3, an adjustable element 4, a rotating element 5, and a substrate 6.

The substrate 6 has a rounded groove 61. The rotating element 5 has a U shape. The bottom of the rotating element 5 is a rounded plate 51. The rounded plate 51 has two support arms 52 erected therein. Moreover, the rounded plate 51 is deposed on the rounded groove 61, and the rounded plate 51 rotates corresponding to the substrate 6.

In another embodiment, the side of the rounded groove 61 and the rounded plate 51 interlock with each other. A plurality of angular scales are depicted on the top surface of the substrate 6 and connect upon the rounded groove 61 to act as a reference when the illumination direction of the illumination module 1 is being adjusted.

The reflective element 3 is cup-shaped and has a reflective layer coated on an inner surface thereof. The two support arms 52 are pivoted on the opposite outside surface of the reflective element 3 so that the adjustable angle corresponds to the rotating element 5.

The light-emitting element 2 can be an LED, a metal halide lamp, and/or a light bulb. The light-emitting element 2 is screwed or adhered to the adjustable element 4.

The adjustable element 4 is moveable relative to the reflective element 3. To enlarge the lighting range of the light-emitting element 2, the adjustable element 4 is moved up relative to the reflective element 3. To reduce the lighting range of the light-emitting element 2 the adjustable element 4 is moved down relative to the reflective element 3.

Figure 4:
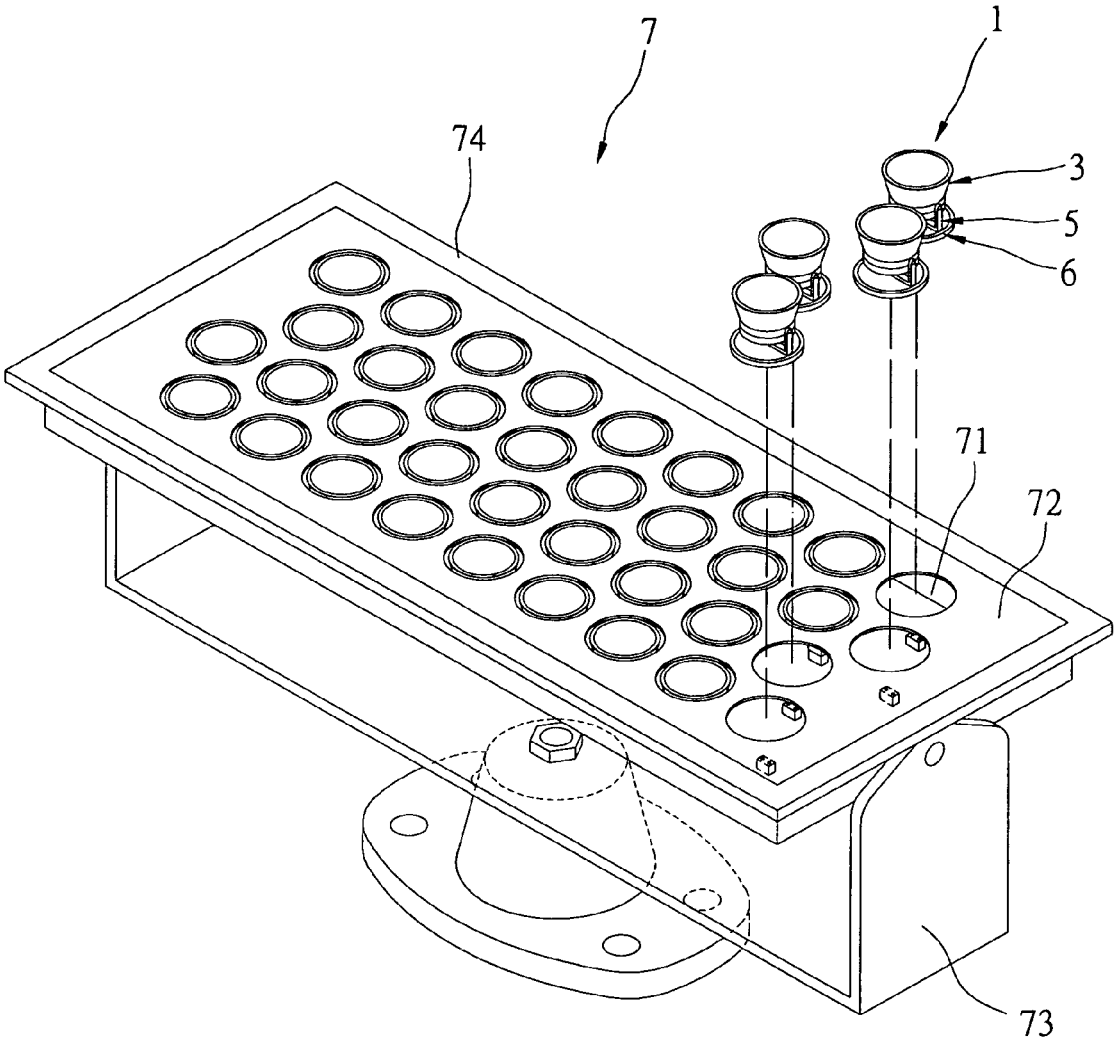
FIG. 4 is a perspective view of a modular illumination device of the present invention.

With reference to FIG. 4, which shows a perspective view of the modular illumination device 7, the modular illumination device 7 comprises a case 74, which includes a plurality of grooves 71. The grooves 71 are arranged in a matrix, which can be arranged in any shape. The illumination devices 1 are deposed on the grooves 71, respectively. In different embodiments, the case 74 can further comprise a cover 72 and a Y base 73. The cover 72 is a transparent material deposed on the case 74. The top of the Y base 73 is pivoted with the opposite surface of the case 74 and pivots corresponding to the rotating element 5.

Figure 5:
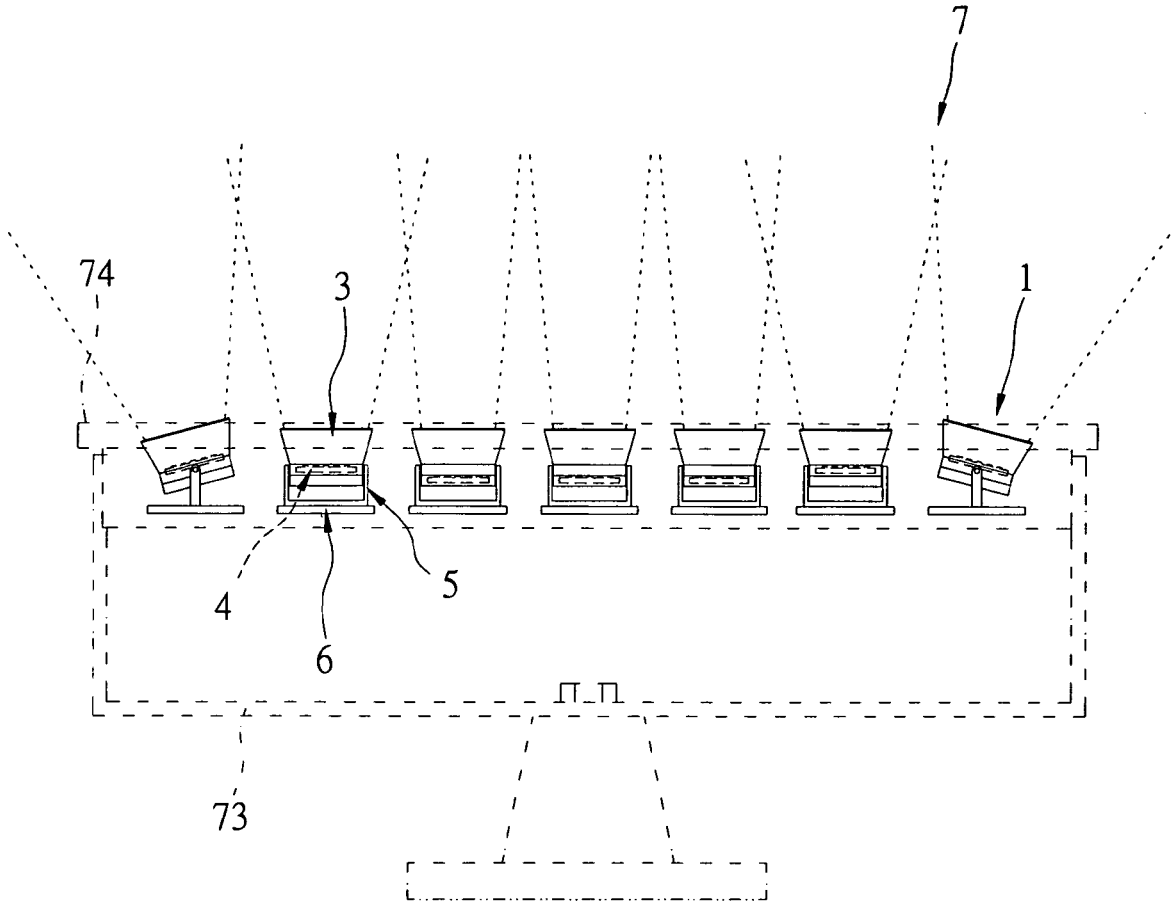
FIG. 5 is a cross-sectional view of the modular illumination device capable of having different illumination ranges via the adjustable illumination modules of the present invention.

Please refer to FIG. 5, which is a cross-sectional view of the illumination range of the modular illumination device 7. The illumination modules 1 are deposed in the case 74. The light range and the light direction of the illumination modules 1 can be adjusted, respectively, to alter the illumination range of the modular illumination device 7.

In another embodiment, the illumination modules can be formed into two or more groups of illumination modules. The illumination modules in each group act together. The groups of illumination modules can be adjusted separately. Each group of illumination modules can operate in a different manner from the other groups of illumination modules. The lighting range and direction of each of the groups of illumination modules can therefore different. Furthermore, these methods increase fabrication speed.

In conclusion, the modular illumination device 7 with adjustable lighting angles is achieved via the illumination modules 1 which have adjustable light ranges and adjustable light directions that combine and operate together to form an adjustable illumination range.

Although possible embodiments of the invention have been described above, it is to be understood that the scope of the invention is not limited to these embodiments; in the same way, all equivalent structures and modifications as implemented in this specification and as illustrated in these drawings are covered within the scope of this invention, in order to protect the rights of the inventor.

What is claimed is:

1. An illumination device with adjustable illumination directions, comprising:

a substrate having a rounded groove;

a rotating element having a top and a bottom, said bottom of said rotating element having a rounded plate rotatably disposed on said rounded groove of said substrate in order to rotate said rotating element relative to said substrate;

a reflective element having two sides pivoted on said rotating element in order to swing said reflective element relative to said rotating element;

an adjustable element longitudinally displaceably disposed within said reflective element in order to be longitudinally adjustable responsive to rotative displacement relative to said reflective element; and at least one light-emitting element disposed on said adjustable element, the light-emitting element being thereby concurrently adjustable in light-projecting angle, longitudinal position relative to said reflective element, and angular position relative to said substrate.

2. The illumination device of claim 1, wherein said rotating element is U-shaped, and a top of said rotating element is pivoted on said reflective element.

3. The illumination device of claim 1, wherein said reflective element is cup-shaped and has a reflective layer coated on an inner surface thereof.

4. The illumination device of claim 1, wherein said adjustable element is screwed on said reflective element, said adjustable element is moved corresponding to said reflective element by rotating the adjustable element.

5. The illumination device of claim 1, wherein said light-emitting element is an LED, a metal halide lamp, and/or a light bulb.

6. The illumination device of claim 1, wherein said light-emitting element is screwed on said adjustable element.

7. An illumination modular for adjusting illumination directions, comprising:

a plurality of illumination devices, each of the illumination devices comprising:

a substrate having a rounded groove;

a rotating element having a top and a bottom, said bottom of said rotating element having a rounded plate rotatably disposed on said rounded groove of said substrate in order to rotate said rotating element relative to said substrate;

a reflective element having two sides pivoted on said rotating element in order to swing said reflective element relative to said rotating element;

an adjustable element longitudinally displaceably disposed within said reflective element in order to be longitudinally adjustable responsive to rotative displacement relative to said reflective element; and at least one light-emitting element disposed on said adjustable element, the light-emitting element being thereby concurrently adjustable in light-projecting angle, longitudinal position relative to said reflective element, and angular position relative to said substrate.

8. The illumination modular of claim 7, wherein said illumination device is arranged in matrix.

9. The illumination modular of claim 7, further comprising a case, said case includes a plurality of grooves and the illumination devices are deposed on the grooves, respectively.

10. The illumination modular of claim 7, wherein said rotating element is U-shaped, and the top of said rotating element is pivoted on said reflective element.

11. The illumination modular of claim 7, wherein said reflective element is cup-shaped, said reflective element has a reflective layer coated on an inner surface thereof.

12. The illumination modular of claim 7, wherein said adjustable element is screwed on said reflective element, said adjustable element is moved corresponding to said reflective element by rotating the adjustable element.

13. The illumination modular of claim 7, wherein said light-emitting element is an LED, a metal halide lamp, and/or a light bulb.

14. The illumination modular of claim 7, wherein said light-emitting element is screwed on said adjustable element.

* * * * *